US010173803B2

(12) United States Patent
Carpenter

(10) Patent No.: US 10,173,803 B2
(45) **Date of Patent: *Jan. 8, 2019**

(54) COMPOSITE CONTAINER WITH SEPARATOR FOR FORMING MULTIPLE COMPARTMENTS

(71) Applicant: SONOCO DEVELOPMENT, INC, Hartsville, SC (US)

(72) Inventor: Lawrence R. Carpenter, Hartsville, SC (US)

(73) Assignee: SONOCO DEVELOPMENT, INC., Hartsville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/861,944

(22) Filed: Jan. 4, 2018

(65) Prior Publication Data

US 2018/0127138 A1 May 10, 2018

Related U.S. Application Data

(63) Continuation-in-part of application No. 15/267,960, filed on Sep. 16, 2016.

(Continued)

(51) Int. Cl.

| | |
|---|---|
| ***B65D 3/24*** | (2006.01) |
| ***B65D 3/04*** | (2006.01) |
| ***B65D 3/22*** | (2006.01) |

(52) U.S. Cl.

CPC ..... *B65D 3/24* (2013.01); *B65D 3/04* (2013.01); *B65D 3/22* (2013.01)

(58) Field of Classification Search

CPC ..... B65D 3/04; B65D 3/22; B65D 3/24

(Continued)

(56) References Cited

U.S. PATENT DOCUMENTS 1,933,468 A * 10/1933 Abbot ..... B65D 85/816 206/217
2,949,369 A * 8/1960 Zoeller ..... B65D 3/00 206/568

(Continued)

FOREIGN PATENT DOCUMENTS

EP 0995688 A 4/2000
EP 1350738 A1 10/2003

(Continued)

OTHER PUBLICATIONS

Extended European Search Report for European Patent Application No. 16190206.9 dated Nov. 8, 2016. All pages cited.

(Continued)

*Primary Examiner* — Christopher Demeree
(74) *Attorney, Agent, or Firm* — Nelson Mullins Riley & Scarborough LLP

(57) ABSTRACT

A composite container is provided for holding one or more products (e.g., snack foods, toys, etc.) in separate compartments within the same container. The container includes a tubular body defining a first end and a second end, and the tubular body extends radially inward at a predefined location between the first and second ends to form an angled ledge. A separator, such as a paperboard or plastic disk, can be placed on the ledge, such that the separator defines a first compartment on one side of the separator and a second compartment on the other side of the separator. In this way, a product can be stored in the first compartment, and a product can be stored in the second compartment, and the user can have access to both in the same container. Associated methods of manufacturing a composite container with multiple compartments are also provided.

16 Claims, 9 Drawing Sheets

Related U.S. Application Data

(60) Provisional application No. 62/246,857, filed on Oct. 27, 2015.

(58) Field of Classification Search
USPC ..... 229/4.5, 93; 206/830; 426/128; 493/158
See application file for complete search history.

(56) References Cited

U.S. PATENT DOCUMENTS

| | | | | | |
|---|---|---|---|---|---|
| 3,186,850 | A * | 6/1965 | Anthony | B65D 1/265 | 206/217 |
| 3,851,757 | A * | 12/1974 | Turpin | B65D 77/08 | 206/459.5 |
| 4,114,784 | A * | 9/1978 | Hough | B65D 81/3216 | 206/216 |
| 5,279,841 | A * | 1/1994 | Yu | B65D 71/502 | 206/503 |
| 5,335,809 | A * | 8/1994 | Toida | A47J 41/0011 | 220/23.88 |
| 5,535,908 | A * | 7/1996 | Sheu | B65D 21/08 | 206/509 |
| 5,950,913 | A | 9/1999 | Rea et al. | | |
| 6,092,717 | A * | 7/2000 | Lowry | B65D 3/24 | 229/120.03 |
| 9,023,445 | B2 * | 5/2015 | Guzzi | B31B 1/00 | 220/626 |
| 9,630,771 | B2 | 4/2017 | D'Amato | | |
| 9,682,791 | B2 * | 6/2017 | Lorence | B65D 3/267 | |
| 9,802,746 | B2 * | 10/2017 | Rhue | B65D 77/2044 | |
| 9,828,138 | B2 * | 11/2017 | Buccellato | B65D 81/3233 | |
| 2003/0178429 | A1 | 9/2003 | Williams et al. | | |
| 2004/0226948 | A1 | 11/2004 | Okushita et al. | | |
| 2017/0113830 | A1 | 4/2017 | Carpenter | | |

FOREIGN PATENT DOCUMENTS

| | | | |
|---|---|---|---|
| EP | 1712479 | A1 | 10/2006 |
| JP | S51-66050 | U | 5/1976 |
| WO | WO 2005051837 | A2 | 6/2005 |
| WO | WO 2014095041 | A1 | 6/2014 |

OTHER PUBLICATIONS

Office Action for corresponding U.S. Appl. No. 15/267,960 dated Sep. 8, 2017. All enclosed pages cited.
Office Action for corresponding European Patent Application No. 16190206.9 dated Mar. 14, 2018. All pages cited.

* cited by examiner

COMPOSITE CONTAINER WITH SEPARATOR FOR FORMING MULTIPLE COMPARTMENTS

CROSS REFERENCE TO RELATED APPLICATIONS

This application claims the benefit of U.S. application Ser. No. 62/246,857 entitled "Composite Container with Separator for Forming Multiple Compartments," filed Oct. 27, 2015, and U.S. application Ser. No. 15/267,960, entitled "Composite Container with Separator for Forming Multiple Compartments," filed Sep. 16, 2016, the contents of each of which are incorporated herein in their entirety.

BACKGROUND

The present disclosure relates to containers and methods for making such containers, and more particularly relates to composite containers.

Food products and other items, such as toys and consumer goods, are often packaged in composite containers that are sealed at both ends. The tubular body cooperates with the base and the lid to define a compartment of the container, in which the product is stored. By opening the lid of the container, the consumer has access to the contents held in the compartment of the container.

For some types of foods and consumer products, multiple items are beneficially sold to the consumer together. For example, some types of foods (e.g., chips) may need to be sold with a condiment or dip (e.g., a packet of cheese or salsa). As another example, some types of goods may be part of a promotion or give-away. For example, a container of building blocks may be sold with a small toy or other promotional item. Depending on the nature of the product, it may be undesirable to place both types of products within the same compartment of the container.

BRIEF SUMMARY

A composite container for products is thus described herein that maintains one or more products in separate locations within the same container. Embodiments of the container are easy to manufacture and maintain the barrier properties of the container, while still providing consumers with relatively easy access to the product(s) held within the container. In particular, embodiments of the container include a ledge formed on an internal surface of the container body, where the ledge is designed to support a separator. As a result, when the separator is inserted into the container and supported in place by the ledge, the container is divided into multiple compartments such that products held in different compartments can be physically separated without impairing a user's access to the products.

In one embodiment, a container is provided for holding products, where the container comprises a tubular body defining a first end and a second end. The tubular body extends radially inward at a predefined location between the first and second ends so as to form a ledge, and the ledge is configured to support a separator thereon. Thus, when the separator is supported by the ledge, the separator defines a first compartment on a first side of the separator for holding a first product and further defines a second compartment on a second side of the separator for holding a second product. The ledge, for example, may extend along a circumference of the tubular body at the predefined location.

In some cases, the container comprises at least one paperboard body ply. The at least one paperboard body ply may define an inner surface, and the container may further comprise a metallized Oriented Polypropylene (mOPP) liner ply adhered to the inner surface of the at least one paperboard body ply. A liner sealant may be disposed on an inner surface of the mOPP liner ply.

In some embodiments, a base may be secured to one of the first or second ends, and a lid may be secured to the other of the first or second ends. The first compartment may be located proximate the lid, and the separator may be removable by the consumer to provide access to the second compartment. The separator may, in some cases, be a disk comprising paperboard.

In other embodiments, a method of manufacturing a container for holding products is provided. According to embodiments of the method, a tubular body is formed, and a mandrel is inserted into an interior of the tubular body, wherein the mandrel defines a circumferential groove. The tubular body may be rotated on the mandrel, and a localized force may be applied to an exterior surface of the tubular body at a predefined location corresponding to a location of the groove of the mandrel in the interior of the tubular body as the tubular body is rotated, such that the localized force extends the tubular body radially inward at the predefined location so as to form a ledge. The tubular body may be cut to form a container having a first end and a second end, and the ledge may be disposed at a location between the first and second ends and may be configured to support a separator thereon. Thus, when the separator is supported by the ledge, the separator defines a first compartment on a first side of the separator and further defines a second compartment on a second side of the separator.

In some cases, a separator may be inserted into the interior of the tubular body, such that the separator is supported by the ledge. For example, a vacuum may be used to insert the separator in some cases, whereas in other cases an insertion mandrel may be used to insert the separator.

A first product may be deposited into the first compartment, and the first compartment may be closed by securing a base or a lid to a respective first or second end of the container. The container may then be rotated about a transverse axis for subsequent deposit of a second product into the second compartment. In some cases, the second product may be deposited into the second compartment, and the other of the base or the lid may be secured to the respective first or second end of the container.

The container, in some embodiments, may comprise at least one paperboard body ply that defines an inner surface, and the method may further comprise adhering a metallized Oriented Polypropylene (mOPP) liner ply to the inner surface of the at least one paperboard body ply and disposing a liner sealant on an inner surface of the mOPP liner ply. The liner sealant may comprise a high barrier film.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

DETAILED DESCRIPTION OF THE DRAWINGS

Figure 2:
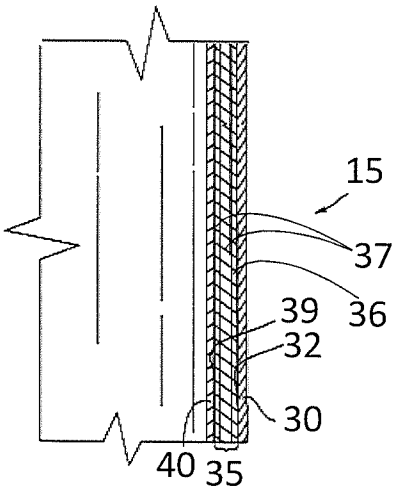
FIG. 2 is a cross-sectional view of a portion of the tubular body of the container of FIG. 1 in accordance with an embodiment of the invention.

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Conventional composite cans are typically rigid, cylindrical containers that have a body made of layers of paper (e.g., paperboard) and ends made of metal or plastic. Composite cans are often used in the packaging of foods, such as coffee, spices, sugar, oatmeal, snacks (e.g., stacked chips), as well as for the packaging of non-foods, such as powders, cleaners, garden products, toys, etc. Depending on the application (e.g., food or non-food), composite cans are generally required to meet certain requirements prior to being approved for use in that application. For example, in some cases, the composite container must be designed to function in high altitude, high temperature, and/or low temperature environments, while also providing a minimum specified shelf-life, such as by preventing the ingress of oxygen and/or moisture, which may harm the product stored inside the container.

Accordingly, conventional containers typically include a liner ply on the inner surface of the paperboard body ply. The liner ply prevents liquids, such as juices, from leaking out of the container and also prevents liquids (e.g., moisture) from entering the container and possibly contaminating the product contained therein. Preferably, the liner ply is also resistant to the passage of gases, so as to prevent odors of the product in the container from escaping and to prevent atmospheric air from entering the container and spoiling the product. Conventional liner plies often include aluminum foil, which has good barrier properties and also has advantageous strength properties.

Conventional composite containers generally include a body, a base at one end of the container, and a lid at the other end of the container. The body, base, and lid cooperate to form an enclosure, or single compartment, within which the product is stored.

As noted above, it would often be beneficial to provide two or more complementary products within the same container. For example, with respect to food, often a main food product is intended for consumption along with another food product. Oatmeal, for example, may be enhanced by condiments such as sugar, cinnamon, nuts, dried fruit, etc. As another example, chips may be enhanced by dips such as cheese or salsa. Although meant to be eaten together, it may be inconvenient, unappetizing, and/or may ruin the products altogether to allow the two complimentary items to intermingle prior to consumption.

As another example, with respect to non-food items (such as toy building blocks) as well as food products, the product may be the subject of a promotion involving another product, such as a free sample product, a coupon book, stickers, toys, etc. Again, however, it may be beneficial to prevent intermingling of the products due to sanitary concerns, consumer convenience, manufacturing considerations, etc.

After continued attempts to solve the problems described above, and through the application of hard work and ingenuity, the inventors have identified tubular body structure for a container, described below, that results in improved composite containers that address the problems identified above.

Figure 1:
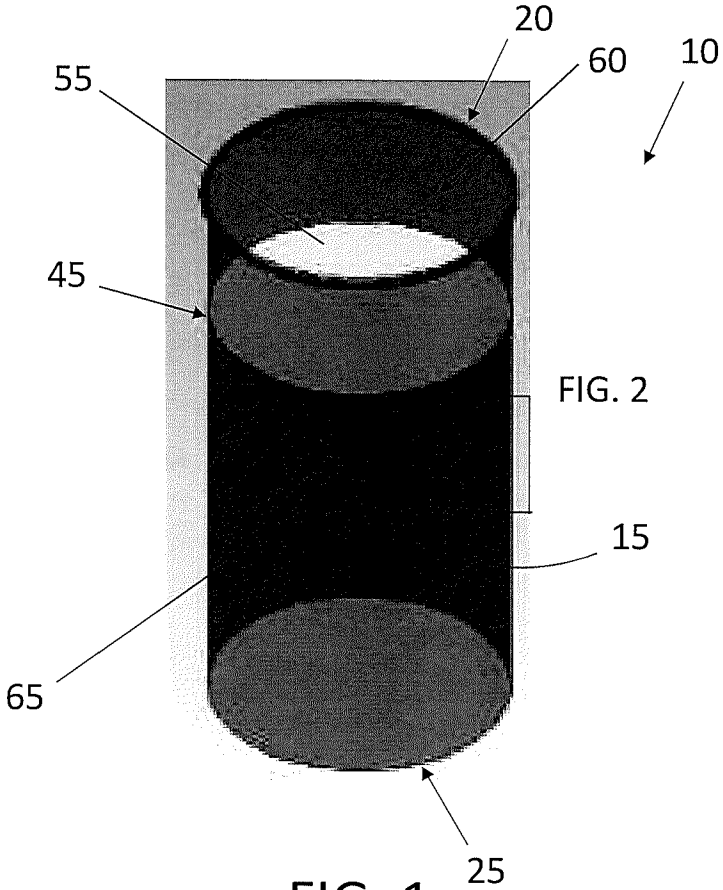
FIG. 1 is a schematic perspective view of a container with a separator forming a first compartment and a second compartment in accordance with one embodiment of the invention.

Turning now to FIG. 1, a composite container 10 is shown according to embodiments of the invention. The composite container 10 may include a tubular body 15 that defines a first end 20 and a second end 25. The tubular body 15 may, for example, comprise at least one paperboard body ply. In some cases, 1 or 2 (or more) plies of paperboard may be spirally wound to form the tubular body 15. Recycled paperboard may, for example, be used in some applications. Moreover, in some cases, a label (e.g., made of paper and/or metal foil) may be applied to an exterior of the at least one paperboard body ply, such as to provide markings indicating the type of product, brand, manufacturer, ingredients, etc. relating to the product held therein. An over lacquer may be applied on an exterior surface of the composite container 10 (e.g., on top of the label) as a protective coating, such as to protect the container body from scratches or other damage that may be caused during shipment or storage of the containers.

FIG. 2 illustrates a cross-section of the tubular body 15 of FIG. 1, as an example. In FIG. 2, for example, the outermost layer of the tubular body 15 is a paperboard body ply 30 (which may be multiple paperboard body plies). A metallized Oriented Polypropylene (mOPP) liner ply 35 may be adhered to an inner surface 32 of the paperboard body ply 30, such as via an adhesive (not shown) between the paperboard 30 and the mOPP liner ply 35. In some embodiments, the mOPP liner ply 35 may be a multilayer liner structure that includes a paper layer 36, a low density polyethylene (LDPE) tie layer (not shown) that holds one or more mOPP film layers 37 to the paper layer, and a liner sealant 40 disposed on an inner surface 39 of the mOPP film layers 37. The paper layer 36 may be adhered to the inner surface 32 of the at least one paperboard body ply 30 to fix the mOPP liner ply 35 to the paperboard body ply.

For example, in some cases, the liner sealant 40 may be a polyethylene-based sealant. Additionally, the liner sealant 40 may comprise a metallocene linear low density polyethylene-high density polyethylene (mLLDPE-HDPE) coextrusion. Furthermore, in some embodiments, the liner sealant 40 may comprise a high barrier film. The high barrier film of the liner sealant 40 may, for example, have a moisture vapor transmission rate (MVTR) of less than 0.01 g/100 $in^2$/day and an oxygen vapor transmission rate (OTR) of less than 1.0 cc/100 $in^2$/day.

Figure 3:
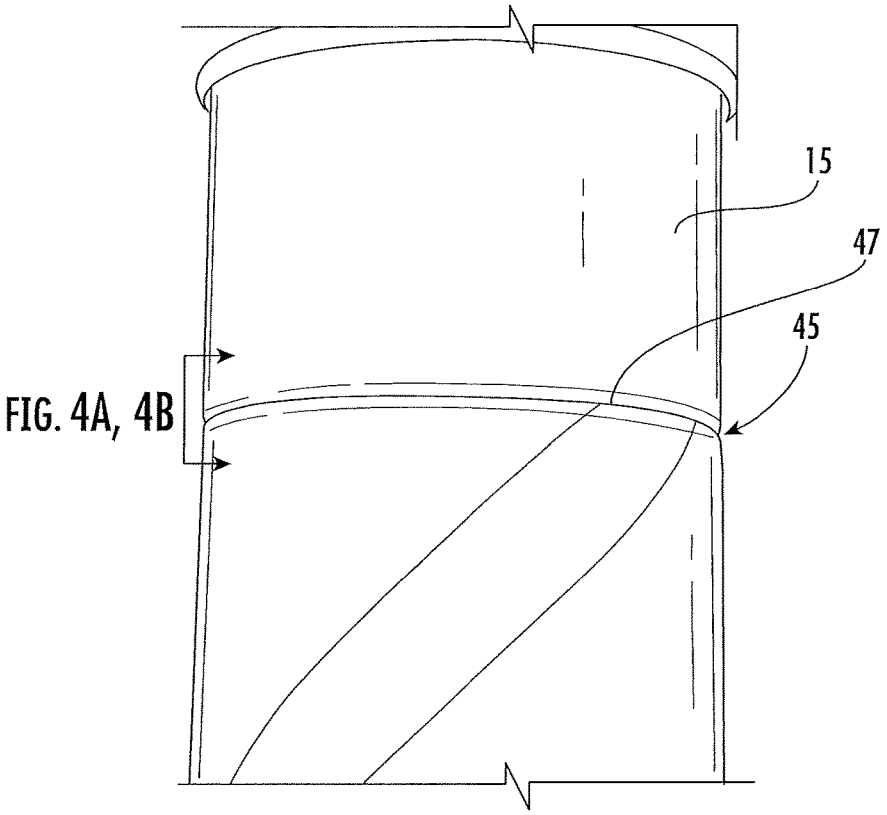
FIG. 3 illustrates a groove in the exterior surface of the tubular body of the container of FIG. 1 corresponding to a location of a ledge formed on the interior of the container in accordance with an embodiment of the invention.

With reference to FIGS. 1 and 3, the tubular body 15 may extend in a generally linear fashion between the first end 20 and the second end 25. At a predefined location 45 between the first and second ends 20, 25, however, the tubular body 15 may extend radially inward, forming a groove 47 on the outer exterior of the composite container and forming a ledge 50 on the inside of the container (shown in FIGS. 4A through 4E). The predefined location 45 may thus be selected to provide a particular depth or volume for first and second compartments 60, 65, depending on the type and/or quantity of products to be stored within.

Moreover, the ledge 50 is configured (e.g., sized, shaped, angled, etc.) to support a separator 55 thereon, as shown in FIG. 4. Thus, when the separator 55 is supported by the ledge 50 as illustrated in FIG. 4, the separator 55 defines the first compartment 60 on a first side of the separator 55 for holding a first product and further defines the second compartment 65 on a second side of the separator for holding a second product.

Figure 4B:
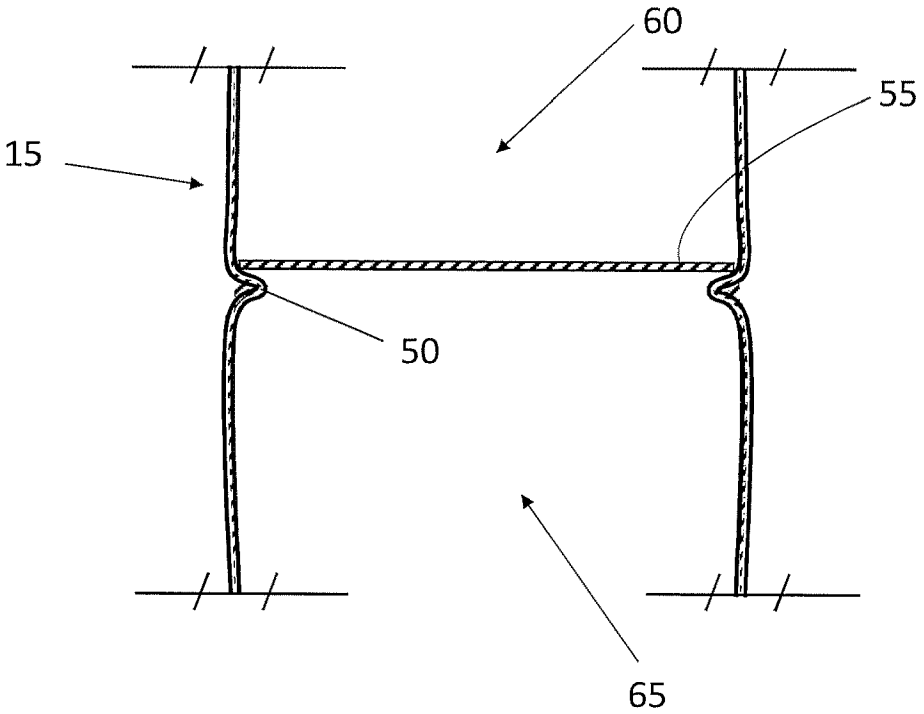
FIG. 4B is a cross-sectional view of a portion of the tubular body of the container of FIG. 3 showing the ledge with a separator in place to form a first compartment and a second compartment in accordance with an embodiment of the invention.
Figure 4A:
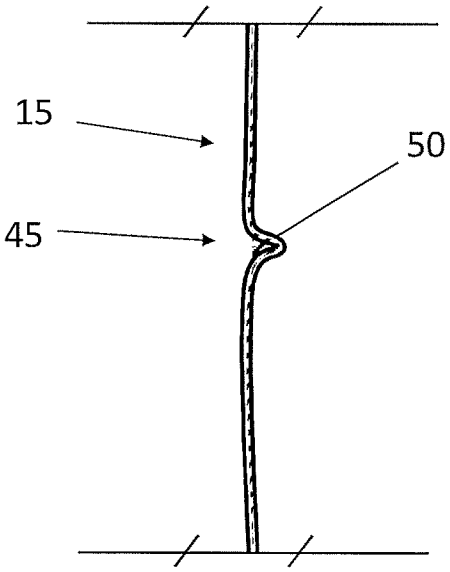
FIG. 4A is a cross-sectional view of a portion of the tubular body of the container of FIG. 3 showing the ledge without a separator in place in accordance with an embodiment of the invention.
Figure 4C:
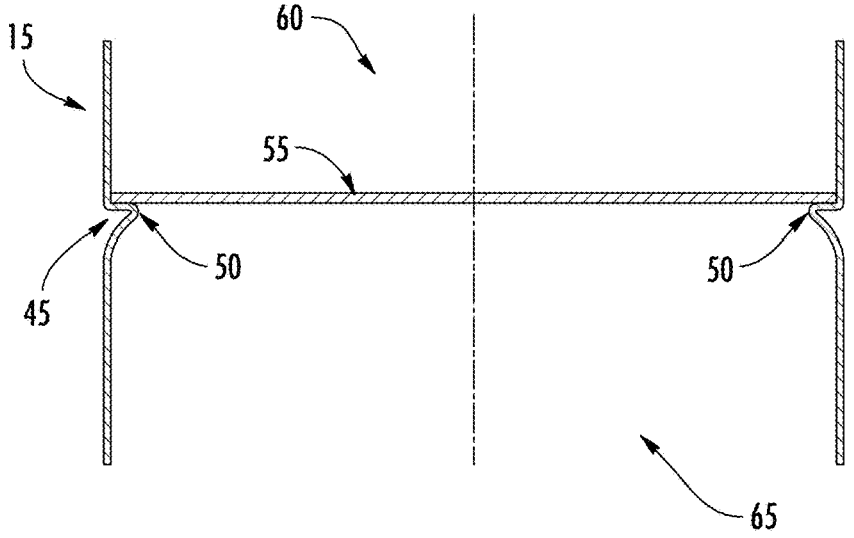
FIG. 4C is a cross-sectional view of a portion of the tubular body of the container of FIG. 3 showing an angled ledge with a separator in place to form a first compartment and a second compartment in accordance with an embodiment of the invention.
Figure 4D:
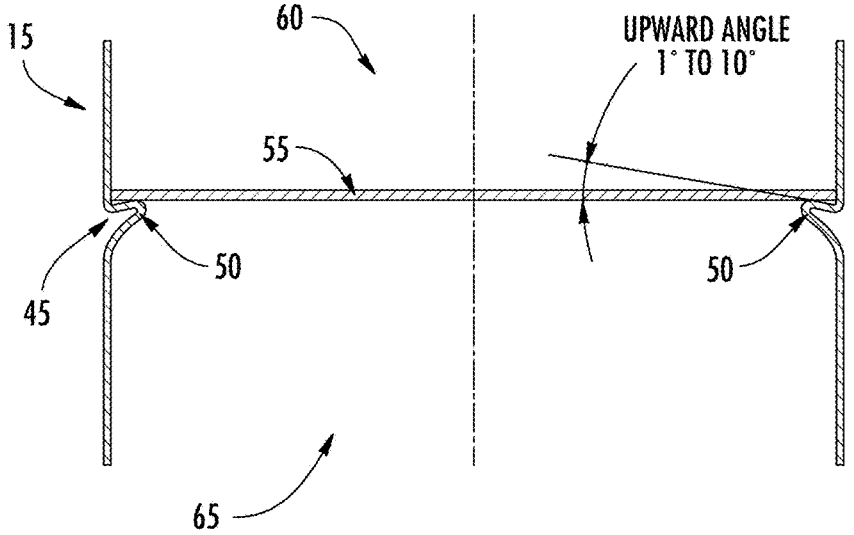
FIG. 4D is a cross-sectional view of a portion of the tubular body of the container of FIG. 3 showing an angled ledge with a separator in place to form a first compartment and a second compartment in accordance with an embodiment of the invention.
Figure 4E:
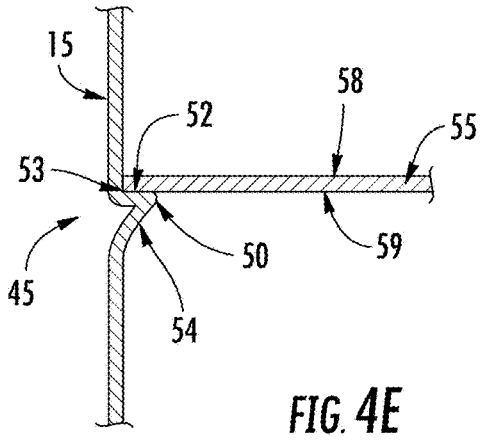
FIG. 4E is an exploded cross-sectional view of a portion of the tubular body of the container of FIG. 3 showing an angled ledge with a separator in place to form a first compartment and a second compartment in accordance with an embodiment of the invention.

In a particular embodiment, shown in FIGS. 4C-4E, the ledge may be angled upwardly. This may be embodied in various ways. In an embodiment, the ledge 50 has a top portion 52 and a bottom portion 54 (shown in FIG. 4E). The ledge 50 may contact and/or support the separator 55 along one or more portions thereof. In an embodiment, the top portion 52 of the ledge 50 may be the portion that is in contact with and/or supports the separator 55. In an embodiment, the separator 55 has a top surface 58 and a bottom surface 59. The contact between the top portion 52 of the ledge 50 and the separator 55 may occur along the bottom surface 59 of the separator 55.

The contact between the ledge 50 and the separator 55 may be continuous, broken, or only present in a single location. In an exemplary embodiment, the entire top portion 52 of the ledge 50 may be flush against the bottom surface 59 of the separator 55, between the wall of the container body 15 and the edge of the ledge 50 (e.g. FIG. 4E). In another embodiment, however, the top portion 52 of the ledge 50 may support the separator 55 near the interior edge of the ledge, as shown in FIG. 4D. In an embodiment, the edge of the ledge itself supports the separator 55. In such an embodiment, there may be a gap between the edge of the ledge 50, the wall of the container body 15, and the separator 55 (see FIG. 4D).

In an embodiment, the body 15 and the ledge 50 converge in a corner 53 (FIG. 4E). In an embodiment, the corner 53 is configured to correspond to the size and dimensions of the separator 55 such that the separator 55 fits substantially flush against both the sidewall of the body 15 and the top portion 52 of the ledge 50.

In an embodiment, the top portion 52 and/or the bottom portion 54 of the ledge 50 is substantially parallel to the separator 55. In this embodiment, the top portion 52 and/or the bottom portion 54 may be angled slightly upwardly, but remains largely parallel to the separator 55 as viewed by the naked eye. In another embodiment, the top portion 52 and/or the bottom portion 54 of the ledge 50 is parallel to the separator 55. In an embodiment, the top portion 52 may be parallel or substantially parallel to the ledge 50, but the bottom portion 54 is disposed at an upward angle. In this or any other embodiment, the upward angle of the bottom portion 54 of the ledge 50 may be between about 1° to about 20°. In an embodiment, the angle of the bottom portion 54 is different from the angle of the top portion 52 of the ledge 50. In an embodiment, the angle of the bottom portion 54 is greater than the angle of the top portion 52 of the ledge 50.

The particular angle of the ledge 50 (the top portion 52 and/or the bottom portion 54) may vary, but may be between about 60° and 90° with respect to the longitudinal axis of the container. In another embodiment, the angle of the ledge 50 (the top portion 52 and/or the bottom portion 54) may be between about 70° and 80° degrees with respect to the longitudinal axis of the container. In another embodiment, the angle of the ledge 50 (the top portion 52 and/or the bottom portion 54) may be between about 80° and 89° degrees with respect to the longitudinal axis of the container. In another embodiment, the angle of the ledge 50 (the top portion 52 and/or the bottom portion 54) may be about 75° with respect to the longitudinal axis of the container.

In an embodiment, the angle of the ledge 50 (the top portion 52 and/or the bottom portion 54) may be between about 1° to about 20° with respect to the separator 55. In an embodiment, the angle of the ledge 50 (the top portion 52 and/or the bottom portion 54) may be between about 1° to about 10° with respect to the separator 55. In a particular embodiment, the angle of the ledge 50 (the top portion 52 and/or the bottom portion 54) may be about 15° with respect to the separator 55.

In a particular embodiment, the top portion 52 of the ledge 50 may have an angle of 90° with respect to the longitudinal axis of the container, which may be parallel to the positioning of the separator 55. The bottom portion 54 of the ledge 50 may have a different angle, for example between about 1° to about 20° with respect to the separator 55. Similarly, the top portion 52 of the ledge 50 may have an angle of 89° with respect to the longitudinal axis of the container, which may be substantially parallel to the positioning of the separator 55. The bottom portion 54 of the ledge 50 may have a different angle, for example between about 1° to about 10° with respect to the separator 55.

In an embodiment, the ledge may be crimped, such that substantially no space exists between the top portion 52 and the bottom portion 54 of the ledge 50. In other embodiments, a space may exist between the top portion 52 and the bottom portion 54 of the ledge 50, which may or may not be visible on the exterior of the container.

The external circumferential groove 47 may comprise any shape known in the art. For example, the external groove 47 may be symmetrical and substantially perpendicular to the longitudinal axis of the container, as is shown in FIG. 4B. In some embodiments, the groove 47 may be semi-circular. In other embodiments, the groove 47 may be elongated inwardly. In other embodiments, the groove 47 may be angled upwardly to create the upward angled ledge 50, shown in FIG. 4C-4E. The ledge 50 may extend inwardly any amount.

The upwardly-angled ledge 50 provides particular benefits to the invention construction. For example, the upward angle resists downward forces from any materials or products contained in the upper or first compartment 60. The upwardly angled ledge 50 increases the column strength of the container and may prevent or reduce the likelihood of the separator 55 collapsing downwardly due to the weight of the materials or products contained in the upper or first compartment 60. The angled ledge 50 may allow the separator 55 to be made from lighter, less bulky, or less stiff materials that are less expensive. Similarly, fewer layers may be required to comprise the separator 55 and/or the thickness of the separator 55 may be reduced, thereby reducing the overall cost and/or time for manufacture of the container structure. The angled ledge 50 may also allow the separator 55 to support heavier product loads within particularly the first compartment 60.

Figure 5:
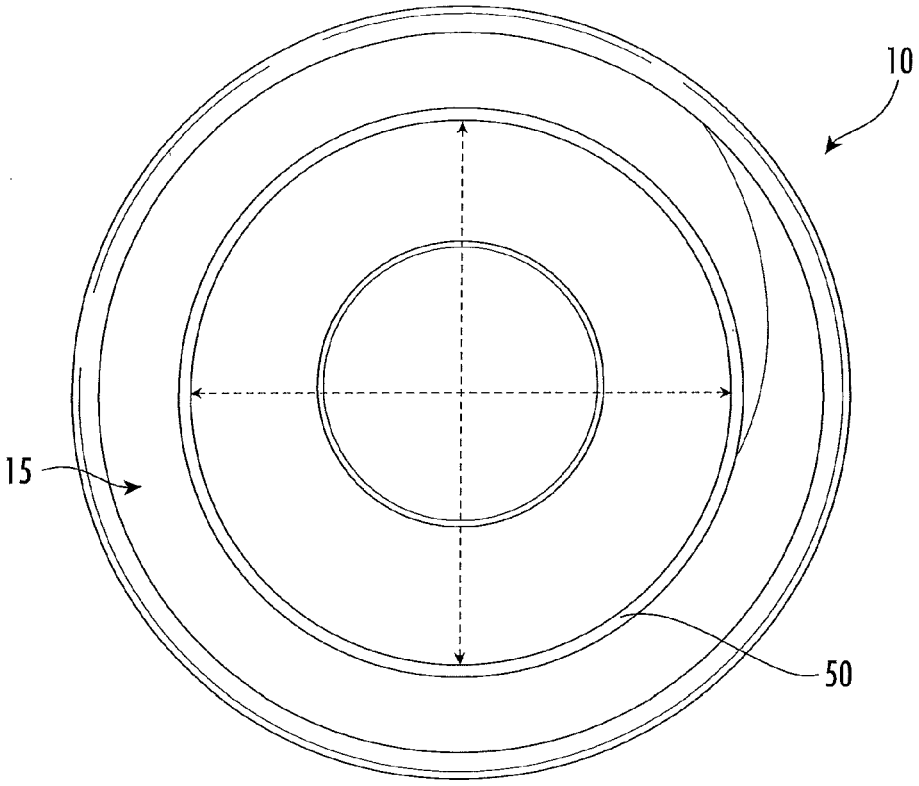
FIG. 5 is a top view of a container with a ledge formed in the tubular body, without the separator in place in accordance with an embodiment of the invention.

In some embodiments, the ledge 50 may extend along a circumference of the tubular body 15 at the predefined location 45, e.g., all the way around the tubular body. A top view of the container 10 showing the ledge 50 extending along the circumference of the tubular body 15 is shown in FIG. 5. In this way, once the separator 55 is inserted into the tubular body to form the first and second compartments 60, 65, the separator 55 may be supported along substantially its entire circumference 56 (shown in FIGS. 6, 8, and 9) by the ledge 50. In other embodiments, however, the ledge 50 may extend along only a portion of the circumference of the tubular body 15. In still other embodiments, the ledge 50 may be intermittent along the circumference of the tubular body 15.

In an embodiment, the separator 55 is friction-fit within the container body 15. That is, the separator 55 may contact the interior side walls of the container body 15 such that some level of friction maintains the position of the separator 55 within the container. However, the level of friction may be low enough that it requires little effort to remove the separator 55 from the container. In other embodiments, no friction at all may be present between the separator 55 and the container body 15. In an embodiment, the container does not restrict the upward movement of the separator 55. In this embodiment, if the container were inverted, the separator 55 may move on its own within the container body 15. In an embodiment, the ledge 50 may restrict movement of the separator 55 downwardly, but the container may not restrict any upward movement of the separator 55. That is, there is no part of the container construction that retains, restrains, or maintains the separator 55 in place other than the forces of gravity acting upon the separator 55. There are no clips or notches that hold the separator 55 in place and the separator 55 is not oversized for a friction fit within the container. In an embodiment, the separator 55 is not adhered or in any other way secured in place. In this embodiment, the separator 55 rests upon the ledge 50, but is not affixed to the ledge 50 or the container body 15. In this embodiment, once the top, cap, or membrane is removed from the container, the product in the upper compartment can be removed and then the separator 55 can be removed without any further structural changes to the container.

Figure 6:
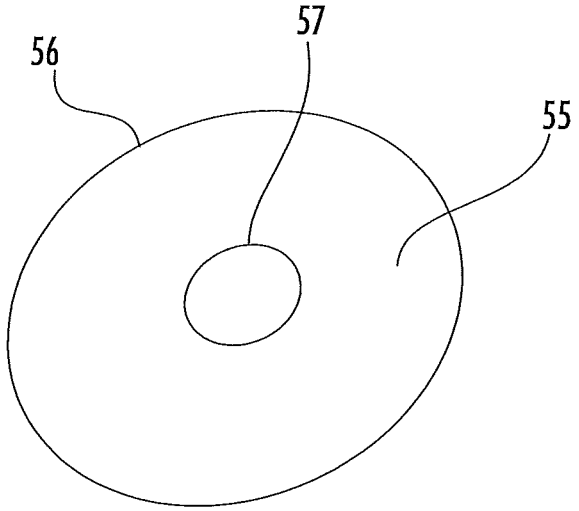
FIG. 6 shows a separator having a through hole in accordance with an embodiment of the invention.
Figure 7:
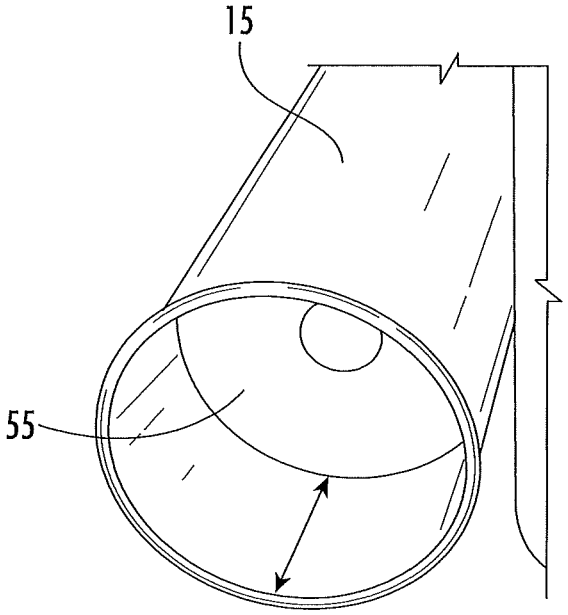
FIG. 7 illustrates a container having the separator of FIG. 6 inserted therein and supported by the ledge in accordance with an embodiment of the invention.

With reference now to FIGS. 6-9, the separator 55 may be configured in different ways according to the type of products to be stored within the container 10, the weight of the product to be supported, the size of the container, the expected method and timing of removal of the separator by the user to gain access to the two products, and/or other considerations and preferences. For example, in the depicted embodiment of FIG. 6, the separator 55 may include at least one through hole 57 configured to permit the user to insert his or her finger into the through hole to pull the separator out of the container 10. A container 10 with a separator 55 configured as shown in FIG. 6 is illustrated in FIG. 7. Alternatively, a plurality of through holes may be presented in the separator. For example, two through hole may be present, allowing a user to insert a thumb and forefinger, for example, into each and remove the separator 55.

Figure 8:
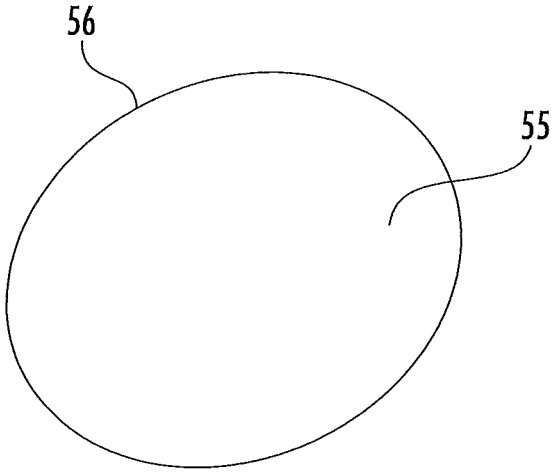
FIG. 8 shows a separator in accordance with another embodiment of the invention.
Figure 9:
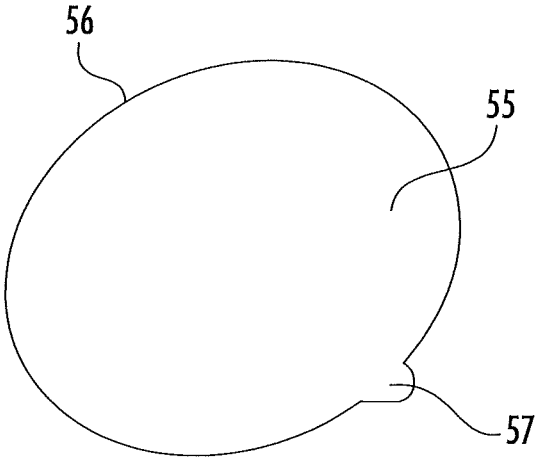
FIG. 9 shows a separator having a tab in accordance with another embodiment of the invention.

In other embodiments, such as the embodiment of FIG. 8, the separator 55 may be circular, as is the separator of FIG. 6, but may not include a through hole. In still other embodiments, such as that illustrated in FIG. 9, the separator 55 may include a tab 57 to facilitate a user's removal of the separator from the container (e.g., by allowing the user to grip the tab 57 and pull the separator 55 out of the container). The tab 57 may be located along the edge of the separator 55 or may be presented on the top surface 58 of the separator 55, located interior of the circumference of the separator 55. Regardless of the configuration, the separator 55 may in some cases be made of paperboard, foil, plastic, and/or combinations of the same, such as paperboard coated with a polymer sealant.

Figure 10:
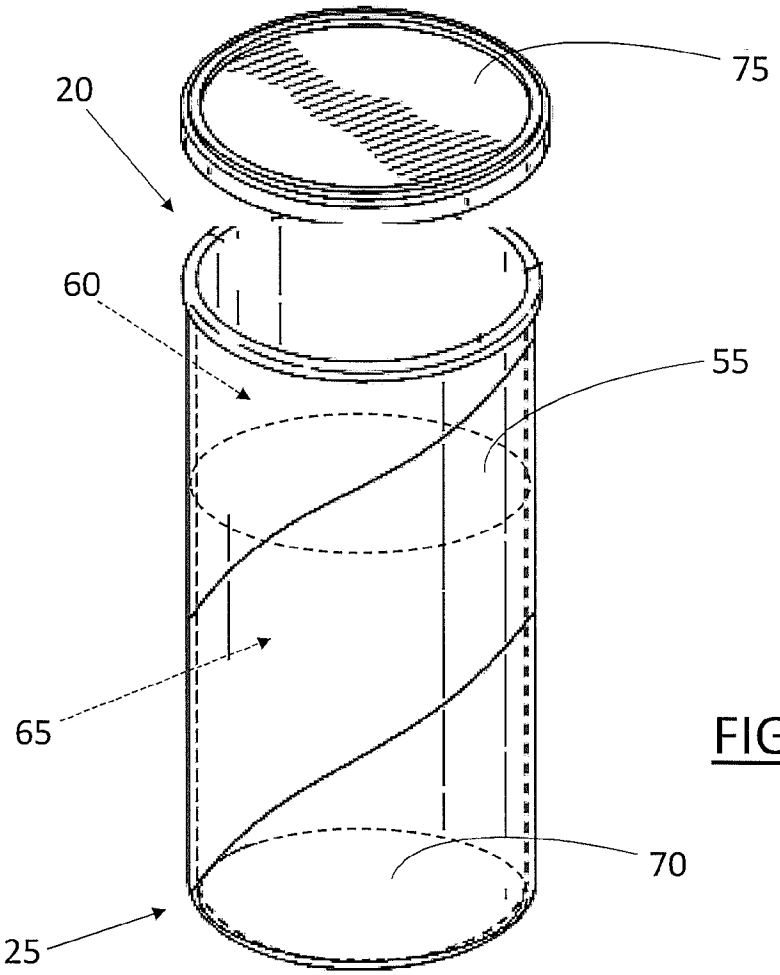
FIG. 10 illustrates a container with a separator, a lid, and a base in accordance with an embodiment of the invention.

In this regard, as noted above, the container 10 may further comprise a base 70 and a lid 75, as shown in FIG. 10. The base 70 may be second to one of the first or second ends 20, 25 and the lid 75 may be secured to the other of the first or second ends. In the embodiment depicted in FIG. 10, for example, the lid 75 is secured to the first end 20 and the base 70 is secured to the second end 25. The base 70 and/or the lid 75 may be a metal cap in some cases while in other cases the base and/or lid may be made of plastic. Moreover, in some embodiments, depending on the product to be stored within the container 10, a membrane (not shown) may be sealed to the respective first or second ends 20, 25, and the lid 75 may be placed over the membrane to close the container 10 until such time that the consumer wishes to gain access to the product inside. The seal between the membrane and the tubular body 15 may, for example, allow the product inside to attain a certain minimum shelf life and may keep the container sealed under different environmental conditions (e.g., high altitude and/or varying temperature extremes). When the user desires to access the products stored within the container, the consumer would first remove the lid 75, then peel off the membrane (not shown) to remove product from one or both compartments 60, 65. At the same time, the lid 75 may be used to reclose the container, even if the membrane cannot be resealed.

In the depicted embodiment of FIG. 10, the first compartment 60 is located proximate the lid 75, and the separator 55 is removable by the consumer (e.g., after the lid has been taken off) to provide access to the second compartment 65. In other words, the consumer may remove the lid 75, may withdraw the product held within the first compartment 60 (e.g., a toy or other promotional item), and may then remove the separator 55 to gain access to the product stored within the second compartment 65 (e.g., toy building blocks).

The container 10 described above with reference to FIGS. 1-10 can be manufactured in various ways and by one or more than one party. For example, in some cases, a manufacturer of the container 10 may form the tubular body and may create the ledge 50 described above, while the separator 55 may be provided and put in place within the tubular body 15 at a later time by a different party, such as the party filling the container with products. In other cases, however, the separator 55 may be inserted at the time the ledge 50 is formed by the manufacturer of the container. Moreover, in still other cases, at least one of the compartments 60, 65 may be pre-filled with the intended product following placement of the separator 55, and the respective first or second end 20, 25 may be closed by securement of a base 70 or a lid 75, respectively, by the same party manufacturing the container 10. The pre-filled container 10 may then be shipped to another party, where the other compartment 60, 65 may be filled with product and the respective end 20, 25 closed to prepare the product-filled container for shipment and ultimate sale to the consumer.

Accordingly, a method of manufacturing a container for holding products is described herein in which a tubular body is initially formed, such as by a process of spirally winding paperboard body plies and/or adhering one or more liner plies (e.g., mOPP liner plies) to the inner surface of the innermost layer of the paperboard body plies. As described above, in some cases depending on the product to be stored within the container, a liner sealant may be disposed on an inner surface of the mOPP liner play, where the liner sealant comprises a high barrier film.

Figure 11:
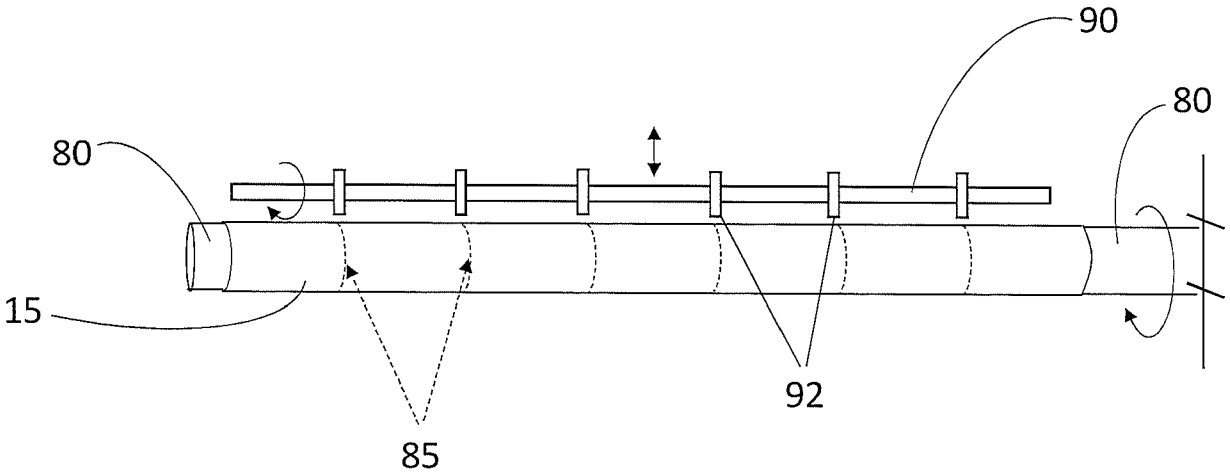
FIG. 11 shows a tool for forming a ledge in a tubular body in accordance with an embodiment of the invention.

Turning to FIG. 11, in some embodiments, once the tubular body 15 is formed, a mandrel 80 may be inserted into an interior of the tubular body 15, where the mandrel defines one or more circumferential grooves 85. The circumferential grooves 85 of the mandrel may be recessed grooves in an embodiment. The grooves 85 may be symmetrical in shape or may be angled so as to create an angled ledge 50 as described herein.

As shown in FIG. 11, the tubular body 15 may comprise an uncut tubular body (e.g., a spirally wound tube that is later cut into a number of tubular bodies for forming a corresponding number of containers). The tubular body 15 may be rotated on the mandrel 80, and a localized force may be applied to an exterior surface of the tubular body at a predefined location (or locations in the depicted embodiment) corresponding to the location(s) of the groove(s) 85 of the mandrel 80 in the interior of the tubular body as the tubular body is rotated. The localized force may be applied, for example, using a tool 90 having rounded blades 92 that are configured to press into the tubular body 15 to push the material of the tubular body inward, towards the corresponding grooves 85, without cutting or tearing the material or otherwise impairing any barrier properties of the material. The tool 90 may be configured to move towards and away from the tubular body 15, with the blades 92 engaging the exterior of the tubular body 15 when the tool is moved towards the tubular body and the tubular body being permitted to come off the mandrel 80 to proceed to a downstream tool or process when the tool is positioned away from the tubular body. The tool 90 may exert force perpendicular to the tubular body or may, in an embodiment, exert force in an angular fashion, so as to create an angled ledge 50, as described herein.

In some cases, the tool 90 is configured to have rotary blades, such that in addition to the mandrel 80 rotating, the tool 90 also rotates as the blades 92 are applied to the tubular body 15. Regardless of the particular configuration of the tool 90, the grooves 85 of the mandrel 80 are configured to receive the inward deflection of the material of the tubular body 15 as the corresponding blades 92 push against the exterior of the tubular body. The localized force thus extends the tubular body 15 radially inward at the predefined location(s) so as to form a ledge as described above. The tubular body 15 may, in such embodiments, then be cut to form a container having a first end and a second end as described above. For example, the tool 90 may also comprise cutting blades (not shown) for cutting the long tubular body into shorter, container-length tubular bodies having first and second ends. In other embodiments, however, the long tubular body may be advanced from the tool 90 shown in FIG. 11 to a downstream cutting tool to be cut into individual container-length tubular bodies.

In other embodiments, however, the long tubular body may be cut into container-length tubular bodies prior to the formation of the ledge. For example, a tool configured to receive an individual container-length tubular body may be used, where the container-length tubular body is inserted of a grooved mandrel 80 into the interior of the tubular body. The tool may, for example, have cammed arms that support rounded or tapered blades, and the cammed arms may be configured to be moved towards the tubular body, such that blades come into engagement with the exterior of the tubular body and apply a localized force to the exterior surface of the tubular body. As described above with respect to the embodiment of FIG. 11, the mandrel carrying the tubular body may be attached to a rotating turret or disk. In this way, the contact of each blade at a single point (where the individual points from each blade are aligned along a single circumferential line of the tubular body exterior) may create a ledge on the interior of the tubular body that extends all the way around the circumference of the tubular body due to rotation of the mandrel and the tubular body, as described above.

Regardless of how the localized force is applied, a ledge is formed that is disposed at a location between the first and second ends of the individual container-length tubular body, and the ledge is in turn configured to support a separator thereon, as described above. Thus, when the separator is supported by the ledge, the separator defines a first compartment on a first side of the separator and further defines a second compartment on a second side of the separator, as shown in FIGS. 1, 4B, and 10, for example.

In some embodiments, the tubular body 15 with the ledge formed therein is moved to a downstream process during which the separator 55 (e.g., shown in FIGS. 6, 8, and 9) is inserted into the interior of the tubular body 15, such that it is supported by the ledge as described above. The separator may be placed via mechanical methods, such as by using an insertion mandrel or robotic arm to push the separator into engagement with the ledge. In other cases, a vacuum may be used to pull the separator into the tubular body and into contact with the ledge. In still other cases, such in small-scale manufacturing processes, a human operator may insert each separator individually into a corresponding tubular body.

In some embodiments, a first product may be deposited into the first compartment as part of the manufacturing process of the tubular bodies. For example, following formation of the ledge (e.g., via the tool 90 shown in FIG. 11 and/or described above), the container-length tubular bodies 15 may be advanced to a collectible dispenser for filling. The collectible dispenser may include, for example, a screw feed system configured to move each tubular body up to a deposit point, where the first product may be deposited into the first compartment and may, for example, come to rest on the separator within the tubular body.

In this regard, a centrifugal bowl may be provided that separates the first product for depositing into the individual containers by moving the product to an outer wall of the centrifugal bowl, where each first product (which may be, for example, in the form of a packet or package as shown) aligns with openings of the centrifugal bowl and drops through the opening, onto a moving belt. In some cases, multiple moving belts may be provided to increase production rates. Each moving belt may, in turn, bring the first products into contact with a rotary pick-and-place unit, which then deposits each first product into a corresponding tubular body at the deposit point, such as via a vacuum. The tubular bodies that have been filled with the first product may then proceed to a downstream stage of the process, which may include further filling/closing operations and/or the packaging of the partially-filled containers for shipment to another party for completion.

In cases where further processing occurs prior to shipment, for example, the first compartment (which has been filled with the first product) may be closed, such as through the securement of a base or a lid as described above, and the container may be rotated about a transverse axis such that the empty, second compartment (in this example) may be filled. Accordingly, a second product may be deposited into the second compartment, and the respective end (corresponding to the second compartment) may also be closed via securement of the lid or the base, respectively, to the respective end.

Although an example method of manufacturing a composite container according to embodiments of the invention is described above with reference to the figures, it is understood that the steps of manufacturing the container may vary in some cases. For example, the order in which certain manufacturing steps occur may vary, and/or in some cases certain steps may be omitted, and others may be added. For example, in some cases, an outer paper label that includes markings identifying the product name, manufacturer, ingredients, etc., as described above, may be applied to the container.

Moreover, the accompanying figures are provided for explanatory purposes and may not show the different layers, plies, adhesives, labels, inks, and other components described above with respect to embodiments of the container. In addition, those components that are illustrated are not necessarily drawn to scale. Thus, certain layers that are shown as the same thickness or thinner than other layers may actually be thicker than other layers, and so on.

Many modifications and other embodiments of the inventions set forth herein will come to mind to one skilled in the art to which these inventions pertain having the benefit of the teachings presented in the foregoing descriptions and the associated drawings. For example, although the embodiments shown and described above include two compartments, other embodiments may include three or more compartments for storing three or more products by forming additional ledges and providing additional separators, as needed. In addition, although the embodiments described above and illustrated in the referenced figures provide for a container with a circular cross-section, embodiments of the invention described above may also be applicable to composite containers having a non-circular cross-section, such as a rounded rectangle cross-section, an oval cross-section, etc. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A container for holding products comprising:

a tubular body defining a first end and a second end, wherein the tubular body extends radially inward at a predefined location between the first and second ends so as to form an upwardly angled ledge, wherein the ledge is configured to support a removable separator thereon, the removable separator which is supported by the ledge wherein, when the removable separator is supported by the ledge, the removable separator defines a first compartment on a first side of the removable separator for holding a first product and further defines a second compartment on a second side of the removable separator for holding a second product.

2. The container of claim 1, wherein the container comprises at least one paperboard body ply.

3. The container of claim 2, wherein the at least one paperboard body ply defines an inner surface, wherein the container further comprises a metallized Oriented Polypropylene (mOPP) liner ply adhered to the inner surface of the at least one paperboard body ply, and wherein a liner sealant is disposed on an inner surface of the mOPP liner ply.

4. The container of claim 1 further comprising a base secured to one of the first or second ends and a lid secured to the other of the first or second ends.

5. The container of claim 4, wherein the first compartment is located proximate the lid, the second compartment is located proximate the removable separator, and the second compartment is accessed by removing the removable separator.

6. The container of claim 1, wherein the removable separator is a disk comprising paperboard.

7. The container of claim 1, wherein the removable separator comprises at least one tab configured to allow removal of the removable separator from the container.

8. The container of claim 1, wherein the removable separator comprises a through hole configured to allow removal of the removable separator from the container.

9. The container of claim 1, wherein the ledge extends along a circumference of the tubular body at the predefined location.

10. The container of claim 1, where the ledge has a top portion and a bottom portion and wherein the top portion is substantially parallel to the removable separator and the bottom portion is upwardly angled.

11. The container of claim 1, where the ledge has a top portion and a bottom portion and wherein the top portion is parallel to the removable separator and the bottom portion is upwardly angled.

12. The container of claim 1, wherein the ledge has a top portion and a bottom portion and wherein the angle of the top portion is between about 1° and about 10° with respect to the removable separator.

13. A container for holding products comprising:

a tubular body defining a first end and a second end, wherein the tubular body extends radially inward at a predefined location between the first and second ends so as to form an upwardly angled ledge, wherein the ledge is configured to support a removable separator thereon, the removable separator which is supported by the ledge and comprises a through hole and wherein, when the removable separator is supported by the ledge, the removable separator defines a first compartment on a first side of the removable separator for holding a first product and further defines a second compartment on a second side of the removable separator for holding a second product.

14. The container of claim 13, wherein the through hole is configured to allow removal of the removable separator from the container.

15. The container of claim 13, wherein the through hole is configured to allow a user to insert an object into the through hole to remove the removable separator from the container.

16. The container of claim 13, wherein the through hole is configured to allow a user to insert a finger into the through hole to remove the removable separator from the container.

* * * * *